US005566624A

United States Patent [19]

Brown et al.

[11] Patent Number: 5,566,624

[45] Date of Patent: Oct. 22, 1996

[54] TWIN-SHEET THERMOFORMED PALLET WITH HIGH STIFFNESS DECK

[75] Inventors: Henry F. Brown, Portage; Dennis A. Giannini, Poynette, both of Wis.

[73] Assignee: TriEnda Corporation, Portage, Wis.

[21] Appl. No.: 515,288

[22] Filed: Aug. 15, 1995

[51] Int. Cl.[6] ..... B65D 19/00

[52] U.S. Cl. ..... 108/51.1; 108/901

[58] Field of Search ..... 108/901, 902, 108/51.1

[56] References Cited

U.S. PATENT DOCUMENTS 3,404,642 10/1968 Belcher et al. ..... 108/901
4,428,306 1/1984 Dresen et al. ..... 108/901
4,879,956 11/1989 Shuert ..... 108/901
5,046,434 9/1991 Breezer et al. ..... 108/901

FOREIGN PATENT DOCUMENTS 0597572 5/1994 European Pat. Off. .

*Primary Examiner*—Peter M. Cuomo
*Assistant Examiner*—Gerald Anderson
*Attorney, Agent, or Firm*—Lathrop & Clark

[57] ABSTRACT

The high stiffness of the legs of a twin-sheet thermoformed pallet are effectively made to contribute to the overall stiffness of the pallet deck by utilizing vertical webs which tie into the legs through a plurality of special purpose depressions or knee joints and which work with narrow channels in the bottom deck which extend parallel to the predominate lines of stress expected to be experienced by the pallet.

11 Claims, 6 Drawing Sheets

FIG. 1
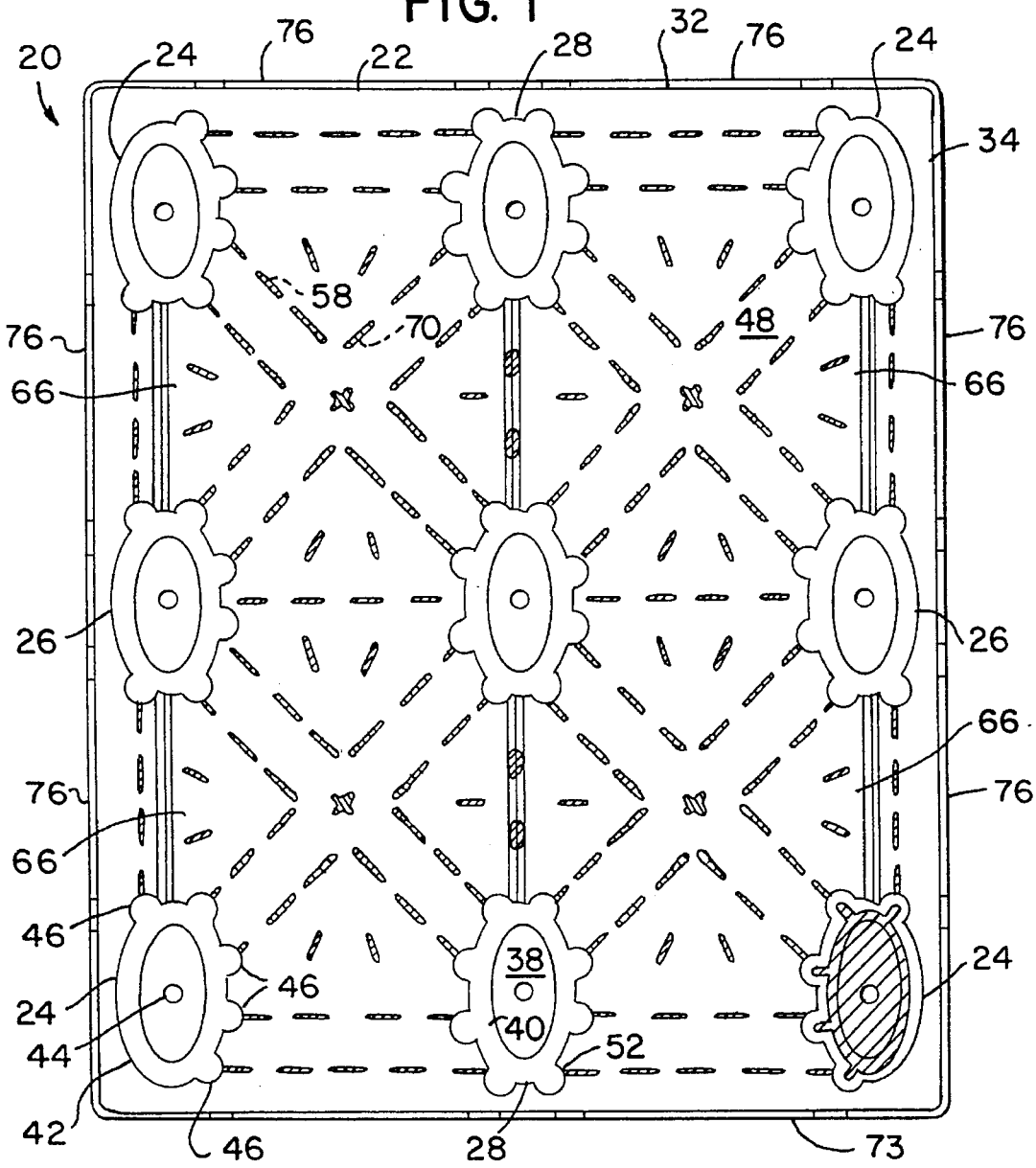
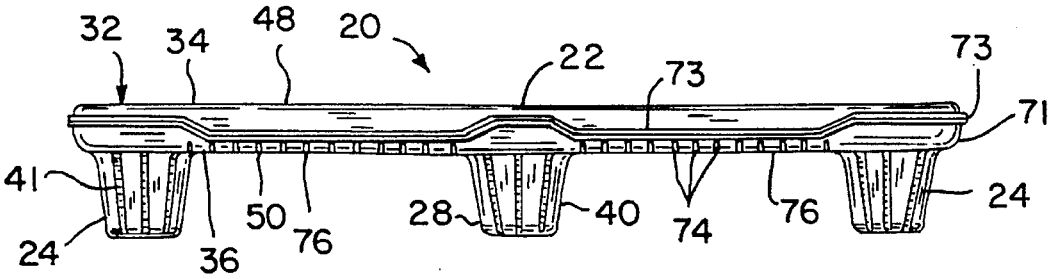
FIG. 2

FIG. 3
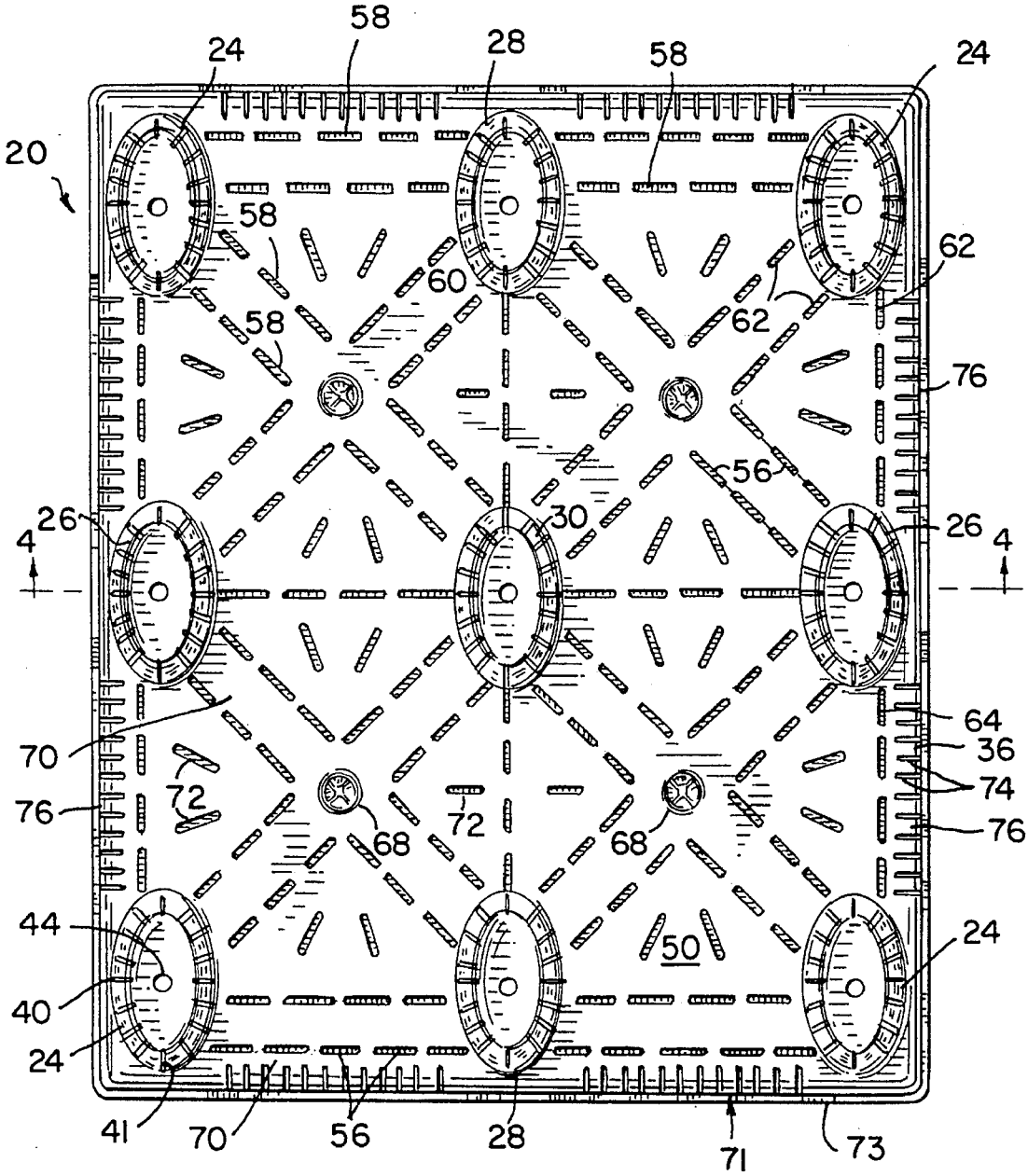
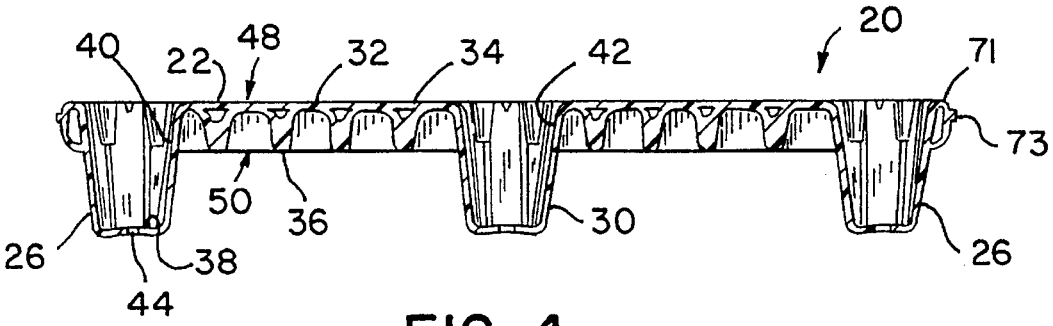
FIG. 4

FIG. 5
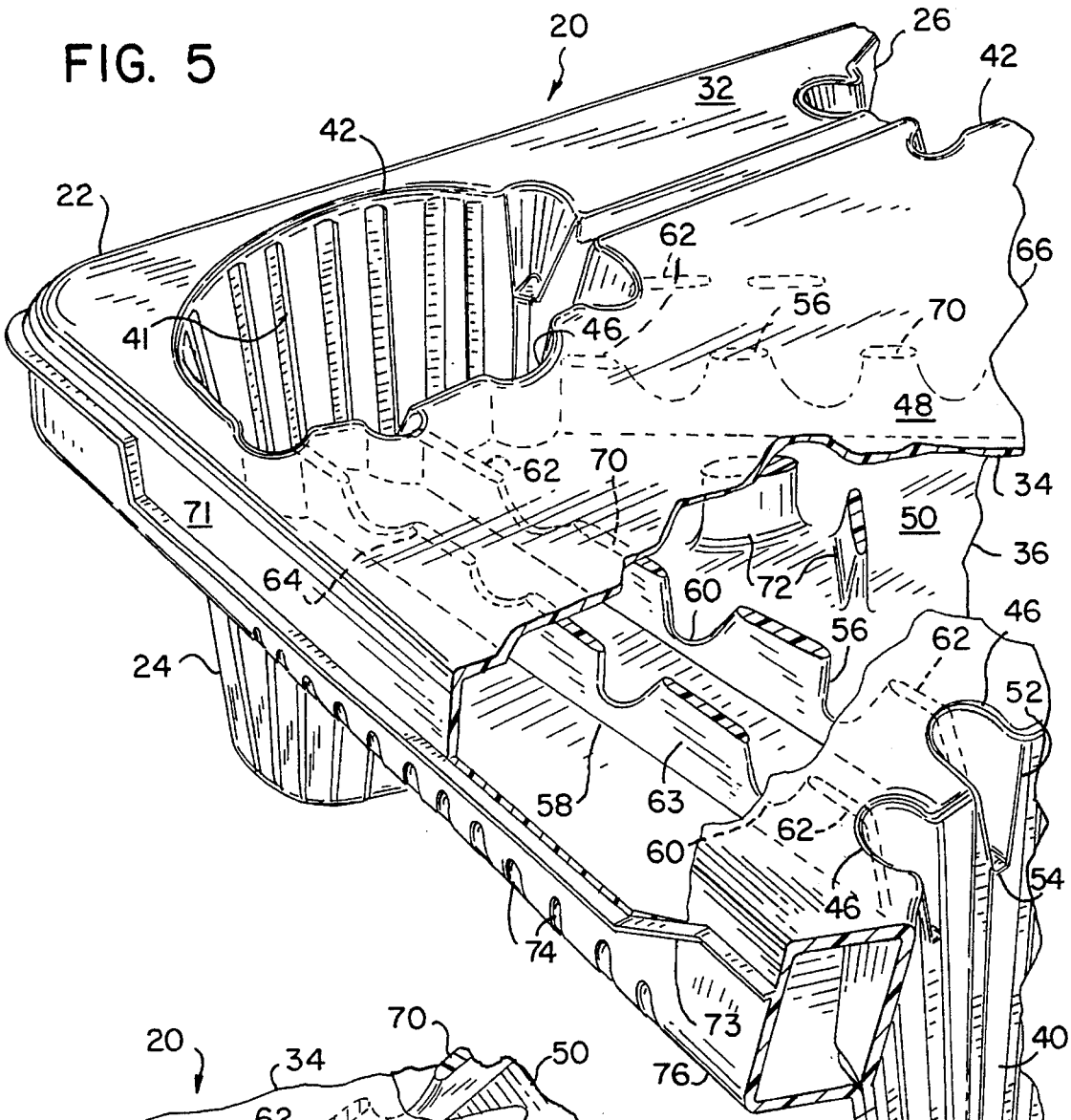
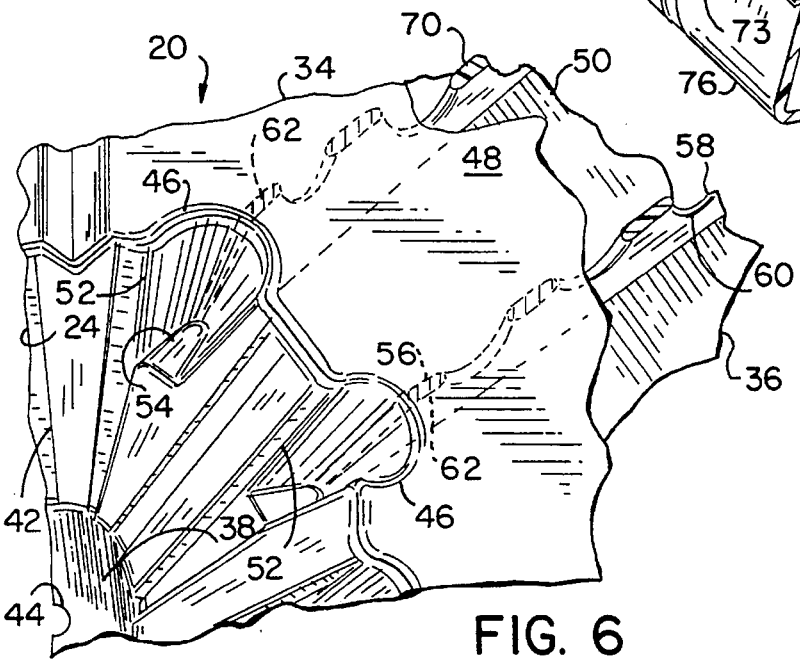
FIG. 6

FIG. 11
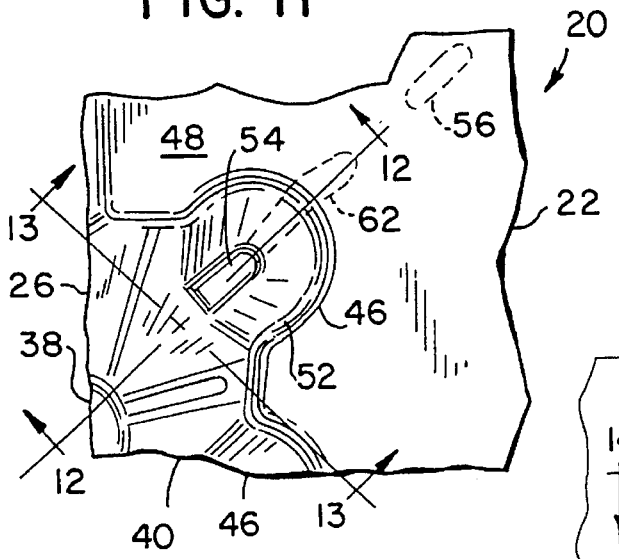
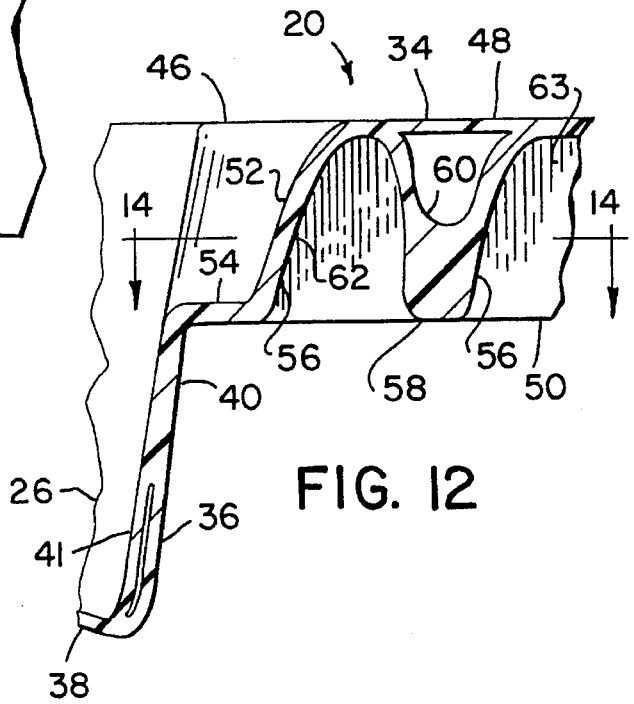
FIG. 12
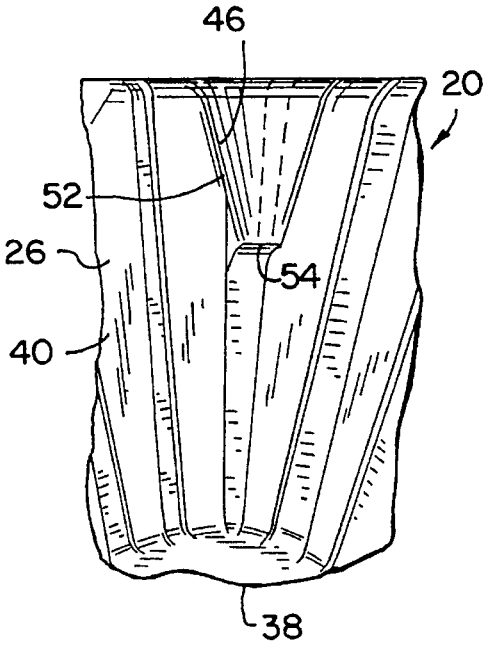
FIG. 13
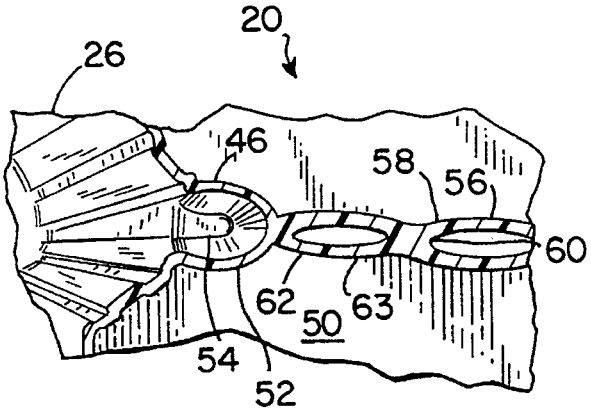
FIG. 14

TWIN-SHEET THERMOFORMED PALLET WITH HIGH STIFFNESS DECK

FIELD OF THE INVENTION

The present invention relates to thermoformed plastic articles in general, and to twin-sheet thermoformed pallets in particular.

BACKGROUND OF THE INVENTION

The storage and transportation of a wide variety of goods is greatly facilitated by the use of pallets. Pallets allow the storage and movement of different items by a common material handling system employing forklift trucks. In the early years of pallet usage, most pallets were constructed of hardwoods because of its low cost, ready availability and high compressive strength.

Wood pallets are still widely used in the industry. However, wood pallets are subject to splintering, moisture absorption, and the steel fasteners which hold wooden pallets together will rust if exposed to water. Plastic pallets are advantageously used where cleanliness, repeated usage or special attachment needs are presented.

All general purpose pallets share several basic structural properties. They have a generally flat upper deck for supporting boxes, canisters or crates, and they have two or more openings for the admittance of fork lift tines. The most universally useful pallet will allow the fork lift tines to enter from all four sides of the pallet. The tine openings may be formed either between a pallet top deck and a pallet bottom deck, or the pallet may have only a single deck with an array of legs which support the deck above a support surface to allow entrance of fork lift tines beneath the deck.

Many manufacturing processes have been adapted to production of plastic pallets: injection molding, cellular foam, blow molding, and rotomolding. However, the large size of pallets, often four feet long or greater, makes the thermoforming process particularly well suited to the production of pallets.

U.S. Pat. No. 4,428,306 to Dresen et al. discloses a pallet produced in a twin-sheet thermoforming process in which the upper sheet is fused to the lower sheet in the walls of downwardly protruding cup-like feet.

In the thermoforming process a sheet of thermoplastic material is heated until it becomes soft and moldable, but not fluid. The heated sheet is held against a mold, whereupon a vacuum is drawn between the mold and the plastic sheet, drawing the sheet down onto the mold, and causing the thermoplastic sheet to conform to the mold's surface. In twin-sheet thermoforming both an upper sheet and a lower sheet are heated and molded simultaneously in two separate molds. The heated sheets are then pressed together within the molds. The effect is to create an article which may have enclosed volumes, and regions of plastic of desired thicknesses.

A key element of the further utilization of plastic pallets is making the pallet competitive with low cost hardwood pallets. A significant portion of the cost of any plastic pallet, especially those produced in large quantities, is the raw material cost of the plastic resin and extruded sheet from which it is fabricated. Hence, the watchword of plastic pallet design is structural efficiency. A high structural stiffness per pound of plastic will yield an economically competitive pallet.

A pallet manufactured by Penda Corporation in the 1980's employed a significant advance in twin-sheet thermoforming structures. This pallet utilized adjacent narrow protruding ribs on one mold half which depressed one heated sheet to fuse to the other. However, the ribs were sufficiently close together that not only did the deformed sheet fuse to the opposite sheet, it also fused to itself at the base of the neighboring rib. These vertical fusions or "webs" provided vertically extending regions of solid plastic which gave pallet designers a valuable tool in increasing structure stiffness.

Pallets can be loaded in a variety of ways, depending on whether the pallet is supported on its legs, on a rack, or on the tines of a fork lift. Many approaches to achieving sufficient deck thickness have been employed, for example by utilizing upper sheet channels which are fused to lower sheet channels which run perpendicular to the upper channels. Despite past successes, economics and competitive pressures drive the need for plastic pallets of ever greater stiffness and load supporting capability at ever-reduced weights.

SUMMARY OF THE INVENTION

The pallet of this invention takes advantage of the high stiffness of the legs of a twin-sheet thermoformed pallet by utilizing vertical webs which tie into the legs through a plurality of special purpose depressions or knee joints and which work with narrow channels in the bottom deck which extend parallel to the predominate lines of stress expected to be experienced by the pallet.

It is an object of this invention to provide a twin-sheet thermoformed thermoplastic pallet having a high stiffness to weight ratio.

It is another object of the present invention to provide a twin-sheet thermoformed thermoplastic pallet which performs acceptably under multiple loading conditions.

It is also an object of the present invention to provide a twin-sheet thermoformed thermoplastic pallet which is resistant to wear as a result of fork lift tine entry.

Further objects, features and advantages of the invention will be apparent from the following detailed description when taken in conjunction with the accompanying drawings.

BRIEF DESCRIPTION OF THE DRAWINGS

FIG. 1 is a top plan view of the pallet of this invention with regions of fusion between the upper sheet and the lower sheet shown schematically by shaded regions.

FIG. 2 is a front elevational view of the pallet of FIG. 1.

FIG. 3 is a bottom plan view of the pallet of FIG. 1.

FIG. 4 is a cross-sectional view of the pallet of FIG. 3 taken along section line 4—4.

FIG. 5 is a fragmentary perspective view of the pallet of FIG. 1, with portions of the upper sheet cut away to disclose the internal structure thereof.

FIG. 6 is a fragmentary top perspective view of the pallet of FIG. 1, with regions of fusion between the upper and lower sheets shown schematically by shaded regions, and with portions of the upper sheet broken away.

FIG. 11 is a top plan fragmentary view of a foot of the pallet of FIG. 1 showing a knee joint where a deck channel is fused to the foot structure.

FIG. 12 is a cross-sectional view of the knee joint of FIG. 11 taken along section line 12—12.

FIG. 13 is a front elevational view of the knee joint of FIG. 11 as seen from line 13—13

FIG. 14 is a cross-sectional view of the knee joint of FIG. 12 taken along section line 14—14.

DESCRIPTION OF THE PREFERRED EMBODIMENT

Figure 7A:
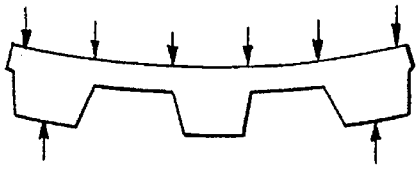
FIG. 7A is a schematic side view of rack loading forces on a pallet.
Figure 7B:
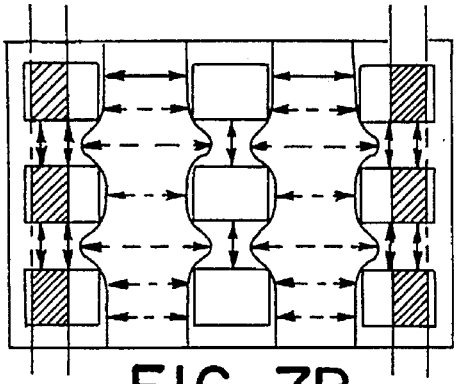
FIG. 7B is a schematic top view of stress lines in the rack loaded pallet of FIG. 7A.
Figure 8A:
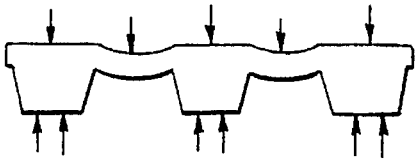
FIG. 8A is a schematic side view of floor supported loading forces on a pallet.
Figure 8B:
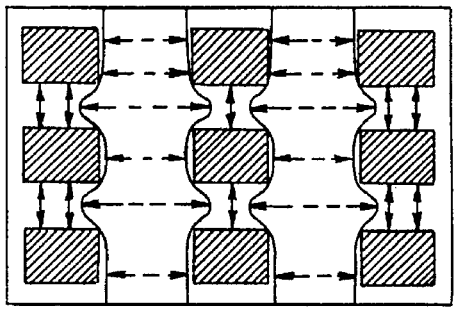
FIG. 8B is a schematic top view of stress lines in the floor supported loaded pallet of FIG. 8A.
Figure 9A:
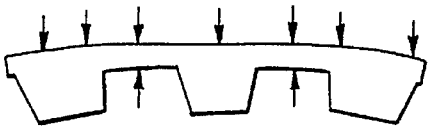
FIG. 9A is a schematic side view of full fork supported loading forces on a pallet.
Figure 9B:
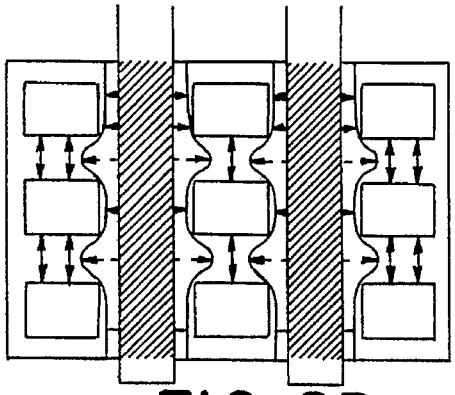
FIG. 9B is a schematic top view of stress lines in the full fork supported loaded pallet of FIG. 9A.

Referring more particularly to FIGS. 1–15, wherein like numbers refer to similar parts, a pallet 20 is shown in FIGS. 1–6 and 11–15. The pallet 20 has a load-supporting deck 22 which is supported a fixed distance above a support surface by nine feet 24, 26, 28, 30.

Palletized loads are commonly transported by an automotive or hand operated lift truck. These devices typically have two elevatable generally horizontal metal tines which are inserted beneath the load to be transported and then elevated and locked in position to move the pallet and supported load. To provide for access by lifting apparatus tines, the deck 22 of the pallet 20 must be spaced above the level of the underlying support surface. The support surface may be pavement or a shop floor, or it may be an underlying loaded pallet.

The pallet deck 22 has a deck surface 32 which is generally flat. For slip resistance an array of narrow height protruding ribs, not shown, is preferably formed on the deck surface 32, in a manner similar to grip plate. The ribs engage the articles supported on the pallet, and restrict sliding of the objects, for example corrugated cartons.

The pallet 20 is formed through a twin-sheet thermoforming process from an upper sheet 34 and a lower sheet 36 of thermoplastic material. Although the molded pallet 20 is a unitary object which is the result of the fusion of the two sheets at particular locations, portions of the pallet which were formed from either the upper sheet 34 or the lower sheet 36 will be referred to herein as a portion of the respective sheet.

The feet 24, 26, 28, 30 are shells which are generally elliptical in horizontal section, and are formed from the fusion of the upper sheet 34 and the lower sheet 36 such that not only the foot floor 38, but a substantial portion of the vertical foot side wall 40 is a fusion of the two sheets. To achieve increased stiffness of each foot, the side wall 40 is formed with a series of ribs 41, best shown in FIGS. 11 and 12, in which the two sheets of the foot side wall are spaced from one another. The ribs are positioned adjacent fully fused sections of the side wall 40.

Each foot 24, 26, 28, 30 has an upwardly opening cavity 42 and a drain hole 44 for the escape of liquids collected in the cavity 42. The pallet feet are particularly stiff, partly due to the fused side wall construction, but primarily because each foot is a deep shell, two to three times as deep as the pallet deck 22. In a pallet with a deck two inches thick, for example, the total depth of the pallet feet 24, 26, 28, 30, may be six inches.

The pallet 20 uses the high stiffness of the pallet feet to contribute to the overall stiffness of the pallet deck 22. As an example of the structural principle employed, consider a building with a flat roof supported on an array of columns. If the roof merely sits on the columns it may be supported in an unloaded condition, but when snow or rain or wind strikes the roof, it will have minimal restraints to wide deflection. If girders or arches extend between the pillars to support the roof, the stiffness of the structure will be greatly improved.

The pallet 20 uses specialized fused depressions on the upper sheet and the lower sheet, referred to herein as knee joints 46, to connect the pallet feet to the deck 22 in a rigidifying manner.

The initial thicknesses of the upper sheet 34 of thermoplastic material will be less than the initial thickness of the lower sheet 36, as the lower sheet undergoes greater deformation in forming, and as it is desirable that the final molded thickness of the deck upper skin 48 be equal to the final molded thickness of the deck lower skin 50. The initial thickness of the thermoplastic sheets will depend on the loads the pallet is expected to encounter, but an exemplary range of initial sheet thicknesses is 125 to 150 thousandths of an inch for the top sheet, and 150–200 thousandths of an inch for the bottom sheet.

As shown in FIG. 1, each knee joint 46 radiates outwardly from a foot cavity 42. The corner feet 24 have five knee joints, the feet 26 on the long dimension sides of the pallet 20 have six knee joints, and the feet 28 on the short dimension sides and the center foot 30 have eight knee joints.

As shown in FIG. 6, each knee joint 46 has a vertically extending shell 52 which is approximately an inverted frustum of a cone. At its top the shell 52 joins the deck upper skin 48, at its base 54 the shell is fused to the deck lower skin 50. Hence the shell is the height of the pallet deck 22.

As shown in FIGS. 3 and 5, a plurality of narrow oblong pockets 56 are formed in the lower thermoplastic sheet 36 which extend upwardly from the deck lower skin 50 and are fused to the deck upper skin 48. The pockets 56 are approximately eight times as long as they are wide, and are approximately 1½ to 2 inches long. A series of pockets 56 are formed along a common axis to define a rib 58. The lower sheet 36 plastic of neighboring pockets 56 is joined at a web 60, as shown in FIG. 12.

Each knee joint 46 shell 52 is fused to the terminal pocket 62 in a row of pockets 56 forming a rib. In a preferred form, the plastic of the terminal pocket 62, formed in the upper sheet 34, is fused in a line extending from the upper skin 48 of the deck to the lower skin 50 of the deck. To assist in a visualization of regions of fusion between the upper sheet 34 and the lower sheet 36, in FIGS. 1 and 6, fused regions have been indicated by shaded areas.

It has been observed that narrow pockets 56 are more effective for forming ribs, as a narrow and thin pocket 56 will suffer less from the tendency of circular pockets to be drawn out of shape. As shown in FIGS. 11–14 the terminal pocket 62 is fused to the shell 52 of the knee joint, and two pocket walls 63 extend from the shell 52 to a web 60 and then to another pocket 56.

As shown in FIG. 1, the ribs 58, rather than being formed in the deck alone, extend between pallet feet. As shown in FIG. 5, in the case of the peripheral ribs 64, which extend along the outer regions of the pallet, each rib 64 extends between two pallet feet and is thus fused to two knee joints 46.

Figure 10A:
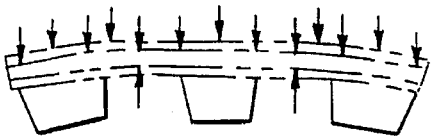
FIG. 10A is a schematic side view of partial fork support loading forces on a pallet.
Figure 10B:
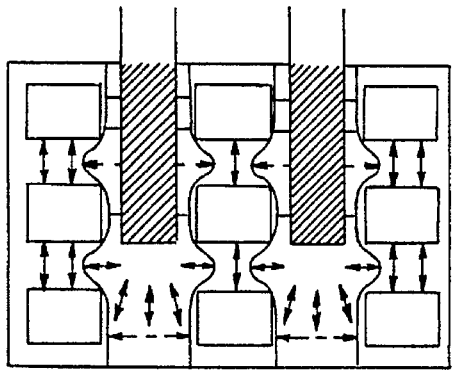
FIG. 10B is a schematic top view of stress lines in the partial fork supported loaded pallet of FIG. 10B.
Figure 15:
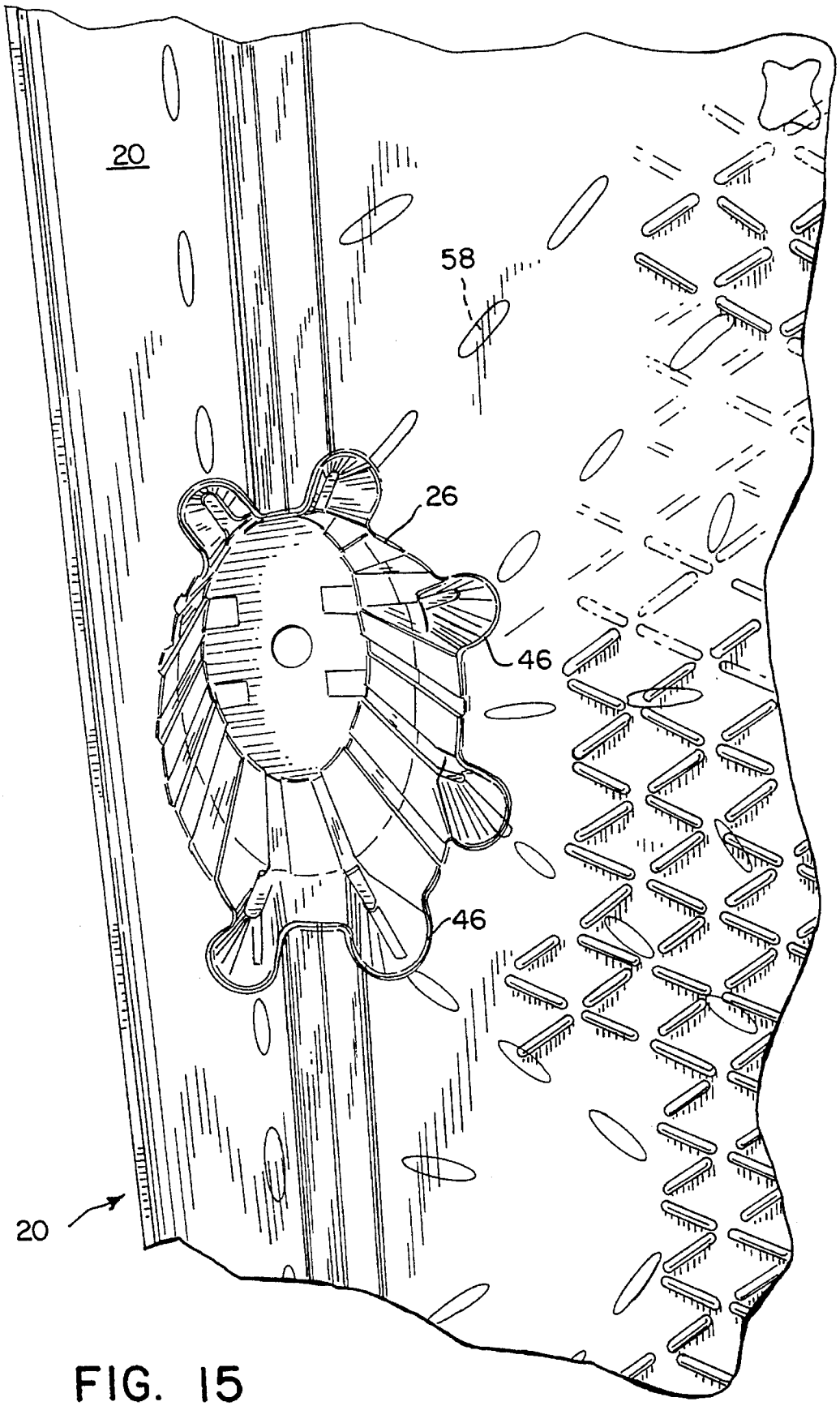
FIG. 15 is a top perspective view of a long side foot and neighboring structure of the pallet of FIG. 1.

As shown in the schematic loading diagrams of FIGS. 7A–10B, there are four main ways in which a conventional pallet is loaded. Rack supported loading is shown in FIGS. 7A and 7B, in which the pallet is supported on a rack by the outer legs only. The lines of stress in floor supported loading is shown in FIGS. 8A and 8B, in which all nine legs are employed. Full fork support of a pallet is shown in FIGS. 9A and 9B in which the tines of a fork lift extend entirely through the pallet and engage only against the deck 22. A particularly demanding loading condition is shown in FIGS. 10A and 10B, in which the tines of the lift truck extend only partly through the pallet, with the result that a portion of the pallet is cantilevered out from the tines. This type of loading may be encountered when a single lift truck is used to elevate two side-by-side pallets, with the tines passing all the way through the first pallet and only partially through the second pallet. In all these common loading patterns, limits on deflections of a pallet edge are typically imposed.

The ribs 58 are positioned to generally be parallel to the predominant lines of stress experienced in common loading conditions to thereby optimize deck stiffness between the supporting feet.

Although single ribs 58 are employed at certain locations, where appropriate the ribs 58 are preferably employed in pairs, as shown in FIGS. 5 and 6, with the pockets 56 of paired ribs being spaced parallel to one another, and in an exemplary pallet being approximately 2½ inches apart.

As shown in FIG. 1, the pallet 20 deck 22 has four inner quadrants 66 generally defined between a corner foot 24, its neighboring long side foot 26 and short side foot 28, and the center foot 30. Each quadrant 66 thus represents a region surrounded by feet but with no foot within it. Each quadrant is reinforced by tying the legs 24, 26, 28, 30 to the deck quadrant 66. The tying is achieved by an arrangement of ribs which creates a structural shape or shapes which connects one foot to another. In general, each foot is connected by such structural shapes to the two adjacent feet, as well as to a foot across the diagonal of the quadrant.

Two ribs 58 extend from each corner foot 24 to the center foot 30 which create a tubular structure. Two ribs 58 also extend from a long side foot 26, shown in FIG. 15, to a short side foot 28. At the center of each quadrant 66, where the ribs extending between one pair of legs might intersect the ribs extending between another pair, the spacing between the individual pockets 56 of the ribs is extended, and a single central pocket 68 is formed. As shown in FIGS. 2 and 3, the central pocket 68 is a generally frustoconical shell formed in the pallet lower sheet 36 which is fused in an X-shape to the upper skin 48 of the deck 22. Alternatively, the central pocket may be formed by two or more individual pockets.

Each rib 58 together with the deck upper skin 48 and the deck lower skin 50 may be considered to form a single beam. For purposes of analysis, the rib and deck skin structure may be considered as a channel beam, an I-beam, or a tube beam, depending upon the surrounding structure, and the approach to analysis. A single rib 58 spaced along the periphery of the pallet 20 may be considered to form a tubular beam 70 with the upper skin 48, the lower skin 50, and the exterior wall 71. Each pair of parallel ribs 58, together with the upper skin and lower skin may also be considered to form a single beam 70. Each beam is positioned to be generally parallel to an expected predominant line of stress. The center pocket 68 may be considered to form a component of two crossing beams 70.

As shown in FIG. 3, pockets 72 are formed in the lower sheet 36 which are exterior to the beams 70 and which do not form a part of any rib 58. Such pockets 72 contribute to the stiffness of the deck 22. These pockets 72 which are not arrayed with other pockets to form a rib, may also be positioned to make a beam 70 more effective by restricting possible modes of buckling or failure of the beam structure. For example, the rib 58 which extends between a long side foot 26 and a corner foot 24, as shown in FIGS. 1 and 3, may be considered to form a channel beam with the lips of the channel being defined by the deck upper skin and the deck lower skin. The tendency of the structure to buckle is then restricted by placing the pockets 72 with respect to the rib 58.

As shown in FIGS. 2, 3, and 5, where the upper sheet 34 and the lower sheet 36 come together around the periphery of the pallet 20, a deck exterior wall 71 is defined by portions of the upper sheet and the lower sheet which are fused together at a seam 73. The pallet deck lower skin 50 may be formed with a row of spaced parallel depressions 74, which are not fused to the upper skin 48 along the tine entry edges 76 between two feet. The seam 73 is preferably formed to be a greater vertical distance from the deck surface 32 immediately above the depressions 74 than above the portions of the deck exterior wall 71 which do not have depressions. By lowering the seam 73 more plastic is available in the molding process to be directed to the depressions 74. The depressions provide a reinforced region where the pallet may be expected to make initial contact with forklift tines, and is thus more resistant to excessive wear.

It should be noted that although a pallet having nine legs has been illustrated and described, pallets having four legs or some other number of legs may also be formed according to this invention. Furthermore, greater or lesser numbers of pockets may be used to form each rib, and ribs of different orientation and number may be employed.

It is understood that the invention is not limited to the particular construction and arrangement of parts herein illustrated and described, but embraces such modified forms thereof as come within the scope of the following claims.

We claim:

1. A twin-sheet thermoformed thermoplastic pallet comprising:

a) a deck having an upper skin and a lower skin;

b) a plurality of feet connected to the deck, wherein each foot has an upwardly opening cavity;

c) a plurality of downwardly opening pockets formed in the pallet lower skin, wherein each pocket is longer than it is wide, and wherein at least a first pocket :and a second pocket are formed in closely spaced relation to one another such that a web of fused plastic material is defined between the first pocket and the second pocket, and wherein said at least first pocket and second pocket define reinforcing deck rib; and d) a downwardly extending shell formed in the deck adjacent a foot cavity, and fused to the deck lower skin, wherein portions of said first pocket are fused to said shell, the foot being thereby joined to the rib.

2. The pallet of claim 1 having at least four feet, wherein a rib extends between each foot and at least one other foot.

3. A twin-sheet thermoformed thermoplastic pallet comprising:

a) an upper thermoplastic sheet, said upper sheet defining a pallet deck top surface; and b) a lower thermoplastic sheet fused in selected locations to the upper thermoplastic sheet, wherein a plurality of upwardly opening legs are formed in the fused upper sheet and lower sheet, and a deck defined by the upper sheet and the lower sheet extends between said legs, and a plurality of downwardly opening pockets are formed in the lower sheet and fused to the upper sheet, each pocket being longer than it is wide, and fused sidewardly to at least one adjacent pocket, and wherein an upwardly opening joint depression is formed in the upper sheet adjacent to a leg, and wherein one of said pockets in said lower sheet is fused to said joint depression to define a rib extending from a leg.

4. The pallet of claim 3 further comprising a plurality of entry depressions formed in the lower sheet and not fused to the upper sheet along a line of entry of a lift truck line beneath the pallet deck.

5. The pallet of claim 4 wherein the upper sheet has a downwardly extending portion which is fused to an upwardly extending portion of the lower sheet at a seam to define a peripheral deck side wall, and wherein the seam above said entry depressions is spaced a greater distance from the deck top surface than the seam not above entry depressions.

6. A twin-sheet thermoformed thermoplastic pallet, comprising;

a) a load-bearing deck formed of an upper sheet of thermoplastic material defining a plane and a lower sheet of thermoplastic material;

b) at least four feet arrayed in a rectangular array, each foot being a downwardly protruding portion of each of said upper and lower sheets joined together at a terminating foot floor; and c) a deck portion defined between each foot of the array and every other of said four feet, wherein said deck portion is reinforced by at least one rib structure extending across said deck portion and between each of said other four feet, wherein each rib structure is defined by at least four aligned pockets, and each pocket is formed by a fused portion of said lower sheet to said upper sheet at approximately the plane defined by the upper sheet the pockets being elongated in a direction the ribs extend, and wherein at least two of said pockets are joined by an upstanding solid web formed in said lower sheet.

7. The pallet of claim 6 wherein the at least one of the four pockets of the at least one rib structure is fused to a foot.

8. The pallet of claim 6 wherein the rectangular array defines side deck portions between adjacent feet and wherein the side portions have continuous ribs formed by continuous adjacent pockets arrayed to form the fibs, the pockets each fusing a portion of said lower sheet to said upper sheet at approximately the plane defined by the upper sheet, said continuous adjacent pockets having an upstanding solid web therebetween and formed in said lower sheet.

9. The pallet of claim 6 wherein the rectangular array defines side deck portions between adjacent feet, and diagonal portions between opposite feet, and a central pocket approximately equidistant from all legs, and wherein the diagonal portions have ribs formed by two segments of angled ribs formed of continuous adjacent pockets arrayed to form the angled ribs between adjacent feet, the pockets each fusing a portion of said lower sheet to said upper sheet at approximately the plane defined by the upper sheet, all said continuous adjacent pockets having an upstanding solid web therebetween and formed in said lower sheet.

10. A twin-sheet thermoformed thermoplastic pallet, comprising;

a) a means forming a deck formed of an upper sheet of thermoplastic material defining a plane and a lower sheet of thermoplastic material;

b) at least four support means for supporting the deck means arrayed in a rectangular array, wherein between each support means and every other of said support means is a means for resisting deflection when the means for forming a deck is subjected to a deflection producing load, and wherein each means for resisting deflection includes at least four pockets arrayed to form the means, the pockets fusing a portion of said lower sheet to said upper sheet at approximately the plane defined by the upper sheet, and the pockets being elongated in a direction the ribs extend, and wherein at least two of said pockets are joined by an upstanding solid web formed in said lower sheet.

11. A twin-sheet thermoformed thermoplastic pallet, comprising;

a) a load-bearing deck formed of a first sheet of thermoplastic material defining a plane and a second sheet of thermoplastic material; and b) at least four feet arrayed in a rectangular array, each foot being a downwardly protruding portion of each of said first and second sheets joined together at a terminating foot floor, wherein between each foot of the array and every other of said four feet is defined a deck portion, each said deck portion being reinforced by at least one rib structure extending across said deck portion and between each of said legs, and wherein each rib is defined by at least four pockets arrayed to form the extending rib, the pockets fusing a portion of said second sheet to said first sheet at approximately the plane defined by the fist sheet the pockets being elongated in a direction the ribs extend, and wherein at least two of said pockets are joined by an upstanding solid web formed in said second sheet.

* * * * *